US009581059B2

(12) United States Patent
Matsuda et al.

(10) Patent No.: US 9,581,059 B2
(45) Date of Patent: Feb. 28, 2017

(54) LUBRICATION SYSTEM FOR VEHICLE ENGINE

(71) Applicant: Kawasaki Jukogyo Kabushiki Kaisha, Hyogo (JP)

(72) Inventors: Yoshiharu Matsuda, Akashi (JP); Shohei Naruoka, Kakogawa (JP); Hisatoyo Arima, Himeji (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 140 days.

(21) Appl. No.: 14/592,667

(22) Filed: Jan. 8, 2015

(65) Prior Publication Data

US 2015/0159525 A1 Jun. 11, 2015

Related U.S. Application Data

(63) Continuation of application No. PCT/JP2013/068916, filed on Jul. 10, 2013.

(30) Foreign Application Priority Data

Jul. 11, 2012 (JP) ..... 2012-155463

(51) Int. Cl.
*F01M 11/02* (2006.01)
*F02B 33/40* (2006.01)
(Continued)

(52) U.S. Cl.
CPC ..... *F01M 11/02* (2013.01); *F01M 1/02* (2013.01); *F01M 5/002* (2013.01); *F01M 11/03* (2013.01);
(Continued)

(58) Field of Classification Search
CPC ..... F01M 11/02; F01M 1/02; F01M 5/002; F02B 33/00; F02B 33/34; F04D 25/02
See application file for complete search history.

(56) References Cited

U.S. PATENT DOCUMENTS 3,805,921 A 4/1974 Marion
4,331,112 A 5/1982 Pluequet
(Continued)

FOREIGN PATENT DOCUMENTS

DE 3832013 3/1990
DE 102009021516 12/2009
(Continued)

OTHER PUBLICATIONS

Notification of Reason(s) for Rejection issued Jan. 5, 2016 for counterpart Japanese Patent Application No. JP2014-524856, 2 pages.
(Continued)

*Primary Examiner* — Lindsay Low
*Assistant Examiner* — Kevin Lathers

(57) ABSTRACT

A combustion engine includes a supercharger which pressurizes intake air to be supplied to an engine body. A lubrication system for the combustion engine includes a main lubrication passage through which lubricating oil flows to lubricate the engine body, a supercharger lubrication passage through which lubricating oil flows to lubricate the supercharger, and an oil pump which supplies a shared lubricating oil to both of the main and supercharger lubrication passages.

8 Claims, 12 Drawing Sheets

(51) Int. Cl.

| | |
|---|---|
| ***F02B 39/04*** | (2006.01) |
| ***F02B 61/02*** | (2006.01) |
| ***F02B 39/12*** | (2006.01) |
| ***F02B 67/10*** | (2006.01) |
| ***F04D 17/10*** | (2006.01) |
| ***F04D 29/62*** | (2006.01) |
| ***F02B 33/34*** | (2006.01) |
| ***F04D 29/054*** | (2006.01) |
| ***F01M 1/02*** | (2006.01) |
| ***F01M 5/00*** | (2006.01) |
| ***F01M 11/03*** | (2006.01) |
| ***F02B 33/00*** | (2006.01) |
| ***F04D 25/02*** | (2006.01) |
| ***F04D 29/60*** | (2006.01) |

(52) U.S. Cl.

CPC ..... *F02B 33/00* (2013.01); *F02B 33/34* (2013.01); *F02B 33/40* (2013.01); *F02B 39/04* (2013.01); *F02B 39/12* (2013.01); *F02B 61/02* (2013.01); *F02B 67/10* (2013.01); *F04D 17/10* (2013.01); *F04D 25/02* (2013.01); *F04D 25/022* (2013.01); *F04D 25/028* (2013.01); *F04D 29/054* (2013.01); *F04D 29/601* (2013.01); *F04D 29/624* (2013.01); *F01M 2011/021* (2013.01); *F01M 2011/022* (2013.01); *F01M 2011/026* (2013.01); *F05D 2220/40* (2013.01)

(56) References Cited

U.S. PATENT DOCUMENTS

| | | | | |
|---|---|---|---|---|
| 5,823,159 | A | 10/1998 | Ariga | |
| 7,299,792 | B1 | 11/2007 | Jones et al. | |
| 8,234,867 | B2 | 8/2012 | Palazzolo et al. | |
| 2007/0199321 | A1 | 8/2007 | Miura et al. | |
| 2008/0072867 | A1 | 3/2008 | Ueshima et al. | |
| 2009/0320471 | A1 | 12/2009 | Palazzolo et al. | |
| 2010/0024415 | A1 * | 2/2010 | Nishiyama | F01D 17/141 60/602 |

FOREIGN PATENT DOCUMENTS

| | | | | |
|---|---|---|---|---|
| JP | 61-038126 | | 2/1986 | |
| JP | 02-070920 | | 3/1990 | |
| JP | 02-163539 | | 6/1990 | |
| JP | 08-312498 | | 11/1996 | |
| JP | 11-257084 | | 9/1999 | |
| JP | 2001-233276 | | 8/2001 | |
| JP | 2002-276383 | | 9/2002 | |
| JP | 2004-270459 | | 9/2004 | |
| JP | 2010-209885 | | 9/2010 | |
| JP | 2011-196336 | | 10/2011 | |
| JP | 2011-196336 | A * | 10/2011 | F01M 9/10 |

OTHER PUBLICATIONS

Office Action with English Translation issued May 3, 2016 in corresponding Chinese patent application No. 201380036352.6 (8 pages).

Extended and Supplementary European Search Report issued May 30, 2016 in corresponding European patent application No. 13817115.2 (7 pages).

PCT Application No. PCT/JP2013/068916 International Preliminary Report on Patentability dated Jan. 22, 2015, 7 pages.

PCT/JP2013/068916 International Search Report, Jul. 31, 2013, 1 page.

* cited by examiner

LUBRICATION SYSTEM FOR VEHICLE ENGINE

CROSS REFERENCE TO THE RELATED APPLICATION

This application is a continuation application, under 35 U.S.C §111(a) of international application No. PCT/JP2013/068916, filed Jul. 10, 2013, which claims priority to Japanese patent application No. 2012-155463, filed Jul. 11, 2012, the entire disclosure of which is herein incorporated by reference as a part of this application.

BACKGROUND OF THE INVENTION (Field of the Invention)

The present invention relates to a lubrication system for a supercharger which is mounted on a vehicle such as a motorcycle and pressurizes intake air to be supplied to an engine body.

(Description of Related Art)

As a combustion engine mounted on a vehicle, there is a combustion engine equipped with a supercharger which pressurizes outside air and supplies the outside air to an engine body (e.g., Patent Document 1). The supercharger is configured to be mechanically interlocked with a rotation shaft of the combustion engine and to be driven by power of the combustion engine, and has an advantage that the efficiency of sucking intake air is increased, thereby increasing output of the combustion engine.

PRIOR ART LITERATURE

[Patent Document 1] JP Laid-open Patent Publication No. H02-163539

In the combustion engine as described above, a supercharger unit is formed as a component separate from the combustion engine, and accordingly, in the case of lubricating a supercharger including a supercharger rotation shaft, a lubrication mechanism is required as a component separate from the combustion engine. Thus the structure around the combustion engine becomes complicated.

SUMMARY OF THE INVENTION

In view of the above problem, an object of the present invention is to provide a lubrication system which allows a structure around a combustion engine to be simplified while lubricating a supercharger.

In order to achieve the above-described object, the present invention provides a lubrication system for a vehicle combustion engine including a supercharger configured to pressurize intake air to be supplied to an engine body, and includes: an engine lubrication passage through which lubricating oil flows to lubricate the engine body; a supercharger lubrication passage through which lubricating oil flows to lubricate the supercharger; and an oil pump configured to supply a shared lubricating oil to both of the engine and supercharger lubrication passages.

According to this configuration, since the shared oil pump supplies the lubricating oil into both the engine body and the supercharger, it is possible to simplify the structure around the combustion engine, thereby suppressing an increase in the size of the combustion engine. For example, when such a lubrication system is applied to a saddle-riding vehicle such as a motorcycle, an increase in the size of a vehicle body is suppressed.

In the present invention, preferably, the lubrication system further includes: an oil filter disposed downstream of the oil pump in a flow direction of the lubricating oil and configured to clean the lubricating oil; and an oil cooler disposed downstream of the oil filter and configured to cool the lubricating oil, the lubricating oil is supplied from a downstream side of the oil cooler through the engine lubrication passage to a to-be-lubricated portion of the combustion engine, and the lubricating oil is supplied from between the oil filter and the oil cooler through the supercharger lubrication passage to the supercharger. If the supercharger lubrication passage is provided at the downstream side of the oil cooler, by an amount of the lubricating oil supplied to the supercharger, the pressure in the engine lubrication passage is reduced. However, according to this configuration, since the supercharger lubrication passage is fluidly connected with the upstream side of the oil cooler, it is possible to suppress a reduction in the pressure in the engine lubrication passage which is caused due to the formation of the supercharger lubrication passage. Since the temperature of a to-be-lubricated portion of the supercharger is low as compared to the to-be-lubricated portion of the combustion engine, it is possible to use the lubricating oil at the upstream side of the oil cooler.

In the present invention, the lubricating oil is preferably supplied through the engine lubrication passage to at least one of a bearing for a crankshaft, a piston, and a wall surface of a cylinder. According to this configuration, since the bearing for the crankshaft, the piston, and the wall surface of the cylinder are to-be-cooled portions which need to be cooled, these portions are effectively cooled by supplying thereto the cooled lubricating oil having passed through the oil cooler.

In the present invention, preferably, the engine body includes a crankcase and a cylinder block, and at least a part of the supercharger lubrication passage is formed within a wall of the crankcase. According to this configuration, since at least the part of the supercharger lubrication passage is formed within the wall of the crankcase, the lubricating oil flowing through the supercharger lubrication passage is cooled by the crankcase which is low in temperature.

In the case where at least the part of the supercharger lubrication passage is formed within the wall of the crankcase, preferably, the supercharger is disposed at an upper portion of the crankcase, and at least the part of the supercharger lubrication passage is formed within the wall of the crankcase so as to extend to the upper portion of the wall of the crankcase. According to this configuration, exposure of the supercharger lubrication passage from the crankcase is avoided, thereby allowing the appearance of the combustion engine to be improved. In addition, it is possible to prevent the lubricating oil from leaking out of the crankcase.

Where the supercharger is disposed in the crankcase, preferably, the supercharger is accommodated in a supercharger case mounted on the crankcase, and an exit of the supercharger lubrication passage defined within the crankcase is formed in an abutting surface of the crankcase which abuts the supercharger case, in which case the supercharger case includes a bearing portion configured to support a supercharger rotation shaft of the supercharger and a supercharger case-side lubricating oil passage which communicates with the exit of the supercharger lubrication passage and introduces the lubricating oil to the bearing portion. According to this configuration, since a passage leading to a bearing portion of a supercharger case is formed merely by mounting the supercharger case on the crankcase, a work operation for forming the passage is easy.

In addition, instead of this, the exit of the supercharger lubrication passage may be arranged near the bearing portion of the supercharger case, and the exit of the supercharger lubrication passage may communicate with an inlet of the supercharger case-side lubricating oil passage through a pipe. According to this configuration, since the supercharger lubrication passage is formed within the crankcase so as to extend to the vicinity of the supercharger case, leakage of the lubricating oil is suppressed.

In the present invention, preferably, the lubrication system further includes a transmission lubrication passage through which lubricating oil flows to lubricate a transmission for vehicle drive, and the lubricating oil is supplied to the transmission lubrication passage by the oil pump. According to this configuration, since the shared oil pump supplies the lubricating oil to the transmission, it is possible to further simplify the structure around the combustion engine, thereby further suppressing an increase in the size of the combustion engine. In this case, the lubricating oil is preferably supplied from between the oil filter and the oil cooler to the transmission lubrication passage. According to this configuration, since the transmission lubrication passage is fluidly connected with the upstream side of the oil cooler, it is possible to suppress a reduction in the pressure in the engine lubrication passage which is caused due to the formation of the transmission lubrication passage.

In the present invention, where there is an idler lubrication passage through which the lubricating oil flows to lubricate an idler shaft, which is a drive shaft of the supercharger, the lubricating oil is preferably supplied from between the oil filter and the oil cooler to the idler lubrication passage, and the supercharger lubrication passage is connected to the idler lubrication passage. According to this configuration, since the idler lubrication passage and the supercharger lubrication passage are located in series, the passages are simplified.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF EMBODIMENTS

A preferred embodiment of the present invention will now be described with reference to the accompanying drawings. The terms "left side" and "right side" used in the description in this specification are the left side and the right side relative to a motorcycle driver or motorcyclist maneuvering the motorcycle to travel forwards.

Figure 1:
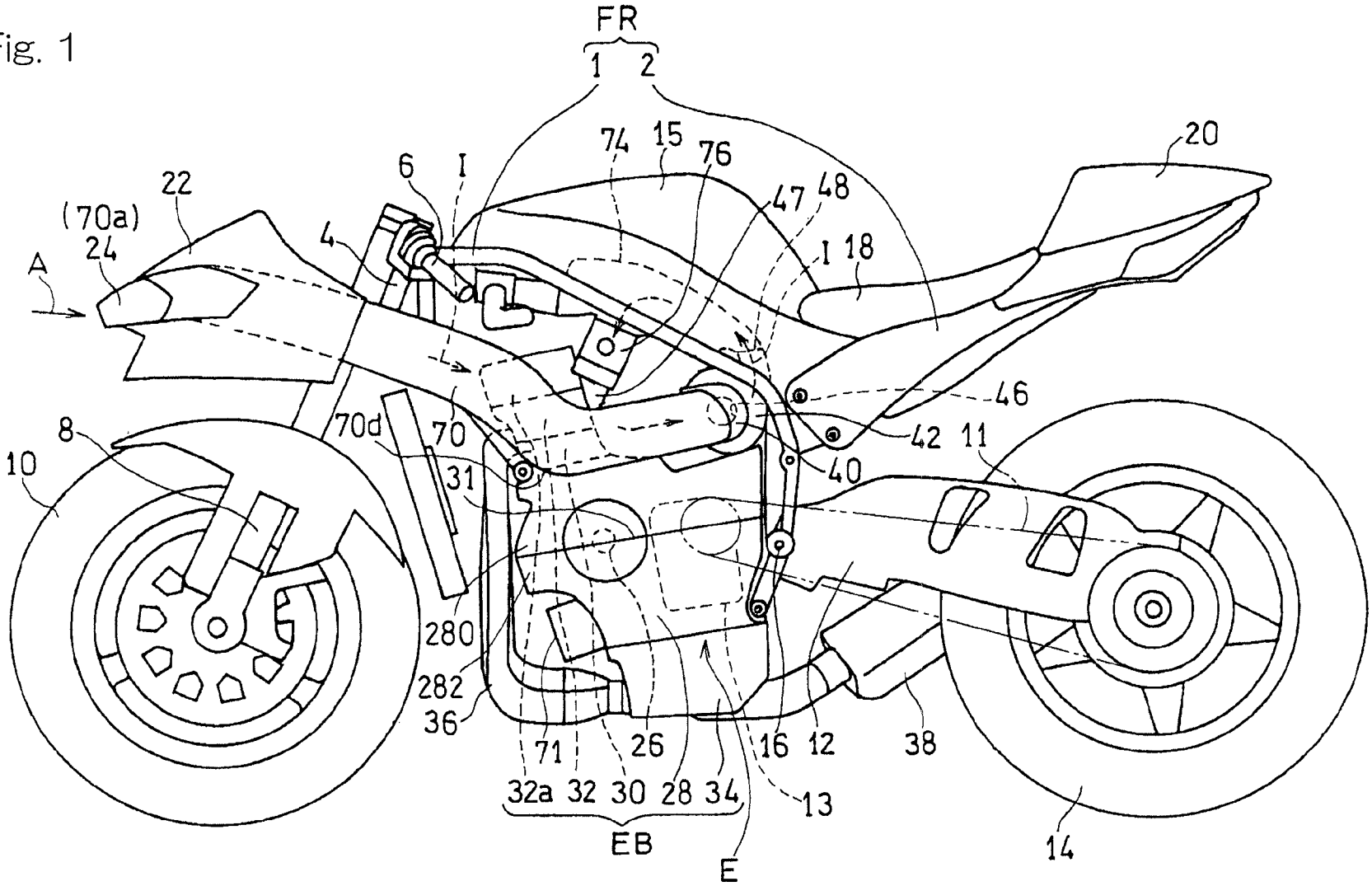
FIG. 1 is a side view showing a motorcycle equipped with a combustion engine including a lubrication system according to a first embodiment of the present invention.

FIG. 1 is a side view of a motorcycle equipped with a combustion engine according to a first embodiment of the present invention. A motorcycle frame structure FR for the motorcycle includes a main frame 1 which forms a front half of the motorcycle frame structure FR, and a seat rail 2 which is mounted on a rear portion of the main frame 1 and forms a rear half of the motorcycle frame structure FR. A front fork 8 is rotatably supported by a head pipe 4 provided at a front end of the main frame 1, through a steering shaft (not shown), and a front wheel 10 is fitted to the front fork 8. A steering handle 6 is fixed to an upper end portion of the front fork 8.

Meanwhile, a swingarm 12 is supported by a rear end portion of the main frame 1, which is a lower intermediate portion of the motorcycle frame structure FR, through a pivot pin 16 for movement in the up-down direction, and a rear wheel 14 is rotatably supported by a rear end portion of the swingarm 12. A combustion engine E is fitted to a lower portion of the main frame 1. Rotation of the combustion engine E is transmitted through a transmission 13, which is a gearbox for vehicle drive, to a drive transmitting member 11 such as a chain disposed at the left side of the motorcycle, and the rear wheel 14 is driven through the drive transmitting member 11.

A fuel tank 15 is disposed on an upper portion of the main frame 1, and a driver's seat 18 and a fellow passenger's seat 20 are supported by the seat rail 2. Also, a front cowl 22 made of a resinous material is mounted on a front portion of the motorcycle body so as to cover front of the head pipe 4. The front cowl 22 has an intake air inlet 24 through which intake air I is introduced from the outside to the combustion engine E.

The combustion engine E is a four-cylinder four-cycle type parallel multi-cylinder engine including a crankshaft 26 which is a rotation shaft extending in a widthwise direction of the motorcycle. The type of the combustion engine E is not necessarily limited thereto. The combustion engine E includes: a crankcase 28 which supports the crankshaft 26; a cylinder block 30 which is connected to an upper portion of the crankcase 28; a cylinder head 32 which is connected to an upper portion of the cylinder block 30; a head cover 32*a* which is mounted on an upper portion of the cylinder head 32; and an oil pan 34 which is mounted on a lower portion of the crankcase 28. A rear portion of the crankcase 28 forms a transmission case which accommodates the transmission (gearbox) 13. The crankcase 28 includes a case upper half 280 and a case lower half 282 which are separable from each other in the up-down direction at a division surface 31.

The crankcase 28, the cylinder block 30, the cylinder head 32, the head cover 32*a*, and the oil pan 34 constitute an engine body EB. Each of the crankcase 28, the cylinder block 30, and the cylinder head 32 of the engine body EB is a molded article obtained by aluminum die-cast. In the present embodiment, the case upper half 280 of the crankcase 28 and the cylinder block 30 are integrally formed by molding.

The cylinder block 30 and the cylinder head 32 are inclined slightly and frontward. Specifically, a piston axis of the combustion engine E extends upward so as to be inclined frontward. A rear portion of the cylinder head 32 is provided with intake ports 47. Four exhaust pipes 36, fluid connected with exhaust ports in a front surface of the cylinder head 32, are merged together at a location beneath the combustion engine E, and are fluid connected with an exhaust muffler 38 disposed at the right side of the rear wheel 14. A supercharger 42, which takes in outside air as intake air I and supplies the outside air to the combustion engine E, is disposed rearward of the cylinder block 30 and at an upper portion of the rear portion of the crankcase 28. That is, the supercharger 42 is located above the transmission 13.

The supercharger 42 compresses outside air sucked in through a suction port 46 thereof, to increase the pressure of the outside air, and then discharges the compressed air through a discharge port 48 thereof to supply the compressed air to the combustion engine E. Accordingly, it is possible to increase an amount of intake air supplied to the combustion engine E. In the supercharger 42, the suction port 46 which is opened leftward is located above the rear portion of the crankcase 28, and the discharge port 48 which opens upward is located at a center portion, in the widthwise direction of the motorcycle, of the combustion engine E.

Figure 2:
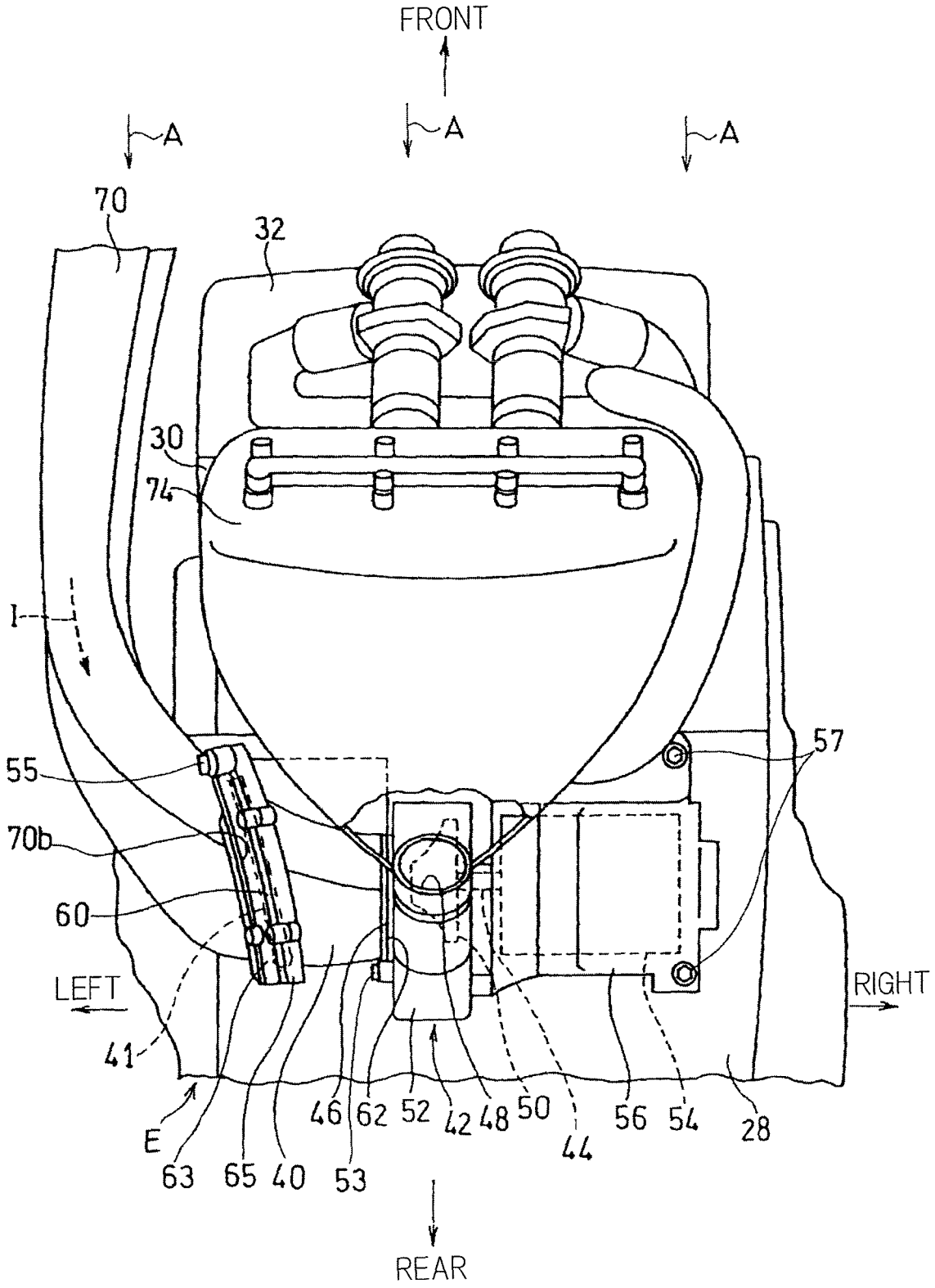
FIG. 2 is a rear perspective view showing a principal part of the combustion engine.

As shown in FIG. 2, the supercharger 42 is a centrifugal supercharger and includes: a supercharger rotation shaft 44 which extends in the widthwise direction of the motorcycle; an impeller 50 which is fixed to the supercharger rotation shaft 44; an impeller housing 52 which covers the impeller 50; a transmission mechanism 54 which transmits power of the combustion engine E to the impeller 50; and a casing 56 which covers the transmission mechanism 54 and a part of the supercharger rotation shaft 44. In the present embodiment, a speed increaser 54 composed of a planetary gear device is used as the transmission mechanism 54.

The impeller housing 52, the casing 56, and a sprocket cover 103 (FIG. 6) described later constitute a supercharger case CS. The supercharger case CS is fixed to an upper surface of the crankcase 28 of the combustion engine E by means of bolts 57. The transmission mechanism 54 and an air cleaner 40 are disposed in the widthwise direction of the motorcycle such that the impeller housing 52 is located therebetween. The impeller housing 52 is connected to the air cleaner 40 by means of a bolt 53.

Figure 3:
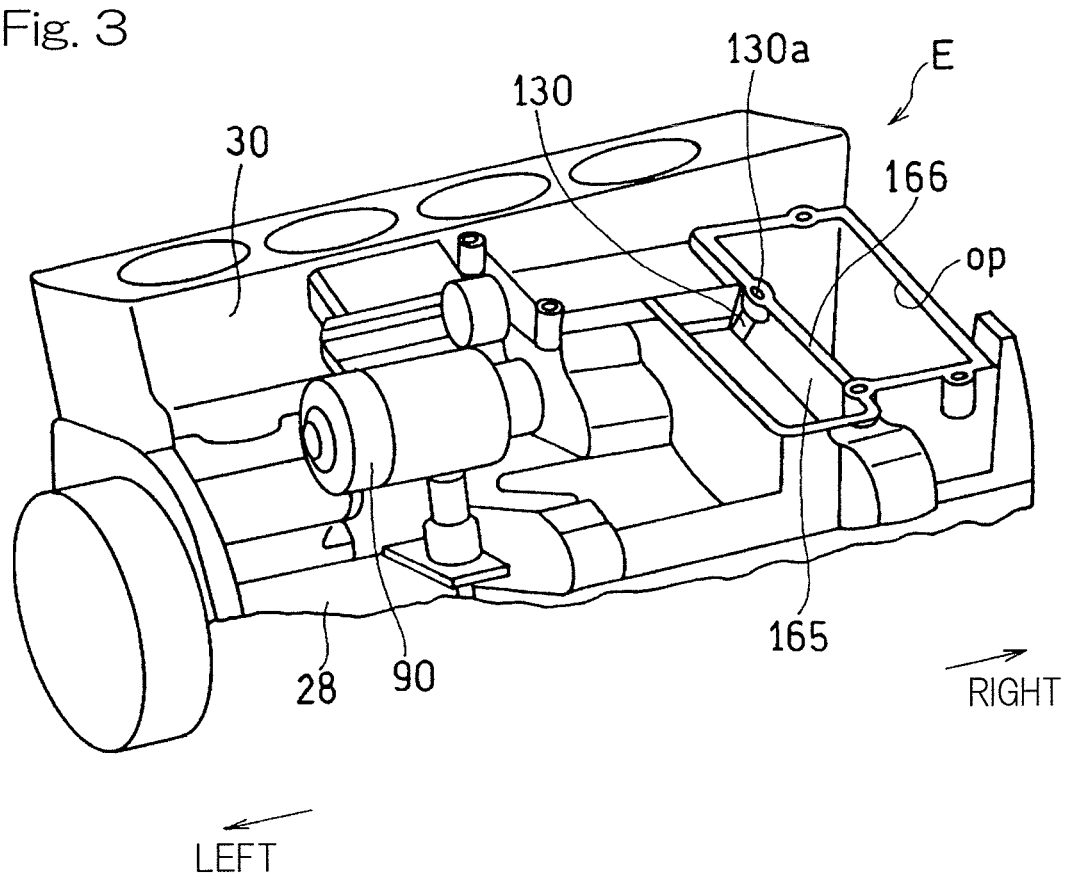
FIG. 3 is a perspective view of a state where a supercharger of the combustion engine is detached, as seen obliquely from the rear and above.

As shown in FIG. 3, an opening OP is formed in the upper surface of the crankcase 28, and this opening OP is closed by the supercharger case CS (FIG. 2) which is supported by the upper surface of the crankcase 28. That is, the supercharger case CS (FIG. 2) also serves as a cover for the opening OP. An upper surface of a peripheral wall 165 of the opening OP is an abutting surface 166 which abuts the supercharger case CS (FIG. 2).

A cleaner outlet 62 of the air cleaner 40 is connected to the suction port 46 of the supercharger 42, and an intake duct 70, which introduces, into the supercharger 42, incoming wind A flowing in front of the cylinder block 30, is connected to a cleaner inlet 60 of the air cleaner 40 from the outer side in the widthwise direction of the motorcycle. The cleaner inlet 60 and a discharge port 70*b* of the intake duct 70 are connected to each other by connecting, by means of a plurality of bolts 55, connection flanges 63, 65 provided at outer peripheries of the cleaner inlet 60 and the discharge port 70*b*, respectively. A cleaner element 41 which cleans intake air I is provided between these connection flanges 63 and 65.

An intake air chamber 74 is disposed between the discharge port 48 of the supercharger 42 and the intake ports 47 of the combustion engine E shown in FIG. 1. The intake air chamber 74 stores the intake air I to be supplied from the supercharger 42 to the intake ports 47. The intake air chamber 74 is disposed above the supercharger 42, and a most part thereof is located rearward of the cylinder block 30.

A throttle body 76 is disposed between the intake air chamber 74 and the cylinder head 32. In the throttle body 76, a fuel is injected into the intake air to generate a fuel-air mixture, and the fuel-air mixture is supplied into cylinders. The fuel tank 15 is disposed above the intake air chamber 74 and the throttle body 76.

The intake duct 70 is supported by the main frame 1 such that a front end opening 70*a* thereof faces the intake air inlet 24 of the front cowl 22. The intake duct 70 increases the pressure of the incoming wind A introduced through the opening 70*a*, by a ram effect, and introduces the incoming wind A as intake air I into the supercharger 42. The intake duct 70 is disposed at the left side of the motorcycle, and extends through a location below a leading end portion of the handle 6 and the outer side of the cylinder block 30 and the cylinder head 32 of the combustion engine E in a side view.

Figure 9:
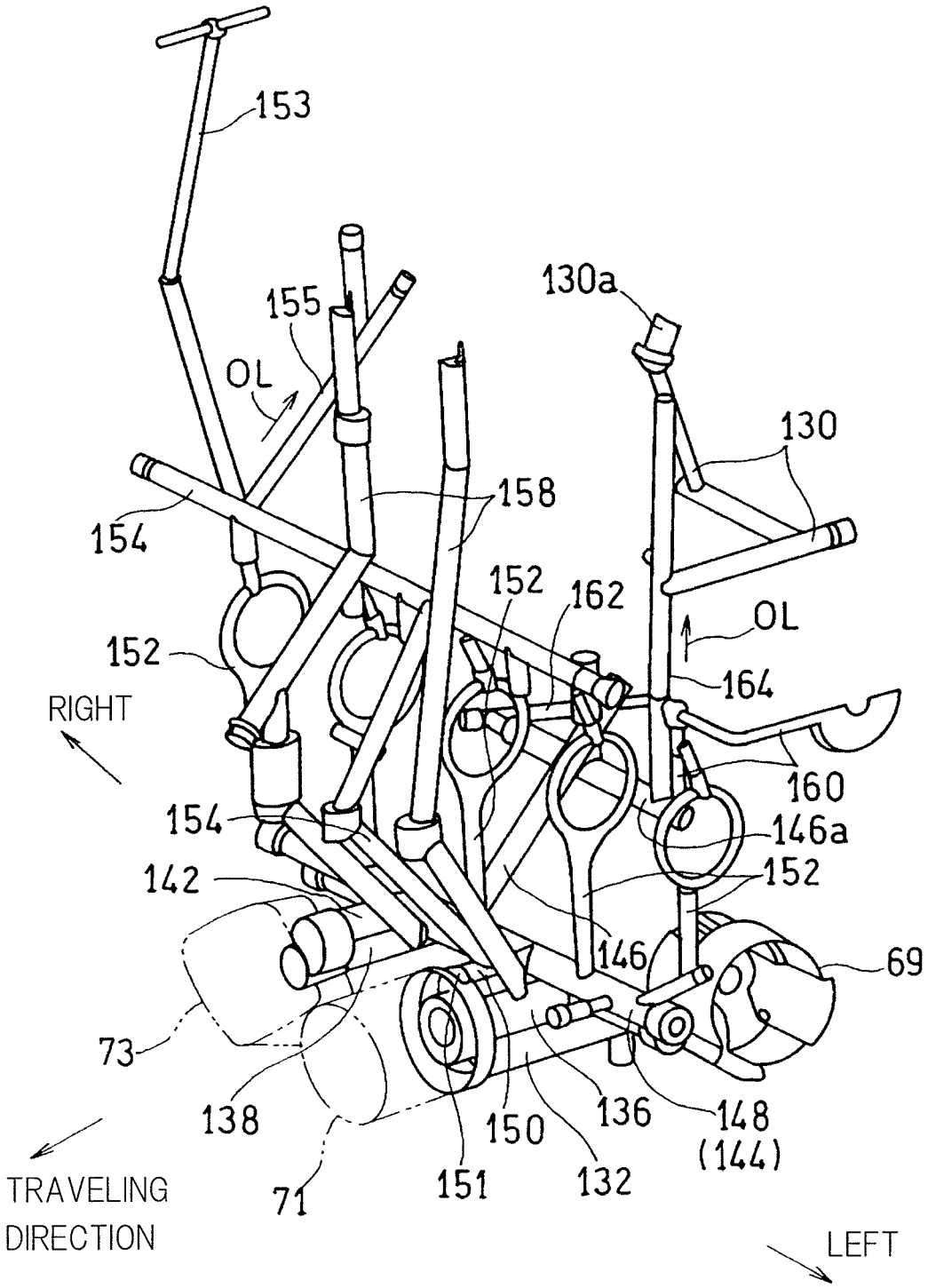
FIG. 9 is a system diagram of the lubrication system of the combustion engine, as seen obliquely from the front lateral side.

As shown in FIG. 9, the combustion engine E includes an oil pump 69 which pumps a lubricating oil OL within the oil pan 34 to the engine body EB, an oil filter 71 which is disposed downstream of the oil pump 69 in a flow direction of the lubricating oil and cleans the lubricating oil OL, and an oil cooler 73 which is disposed downstream of the oil filter 71 and cools the lubricating oil. The oil filter 71 and the oil cooler 73 are disposed on a front surface 28*a* of the crankcase 28 side by side in the widthwise direction of the motorcycle (a right-left direction) which is a first direction.

Figure 4:
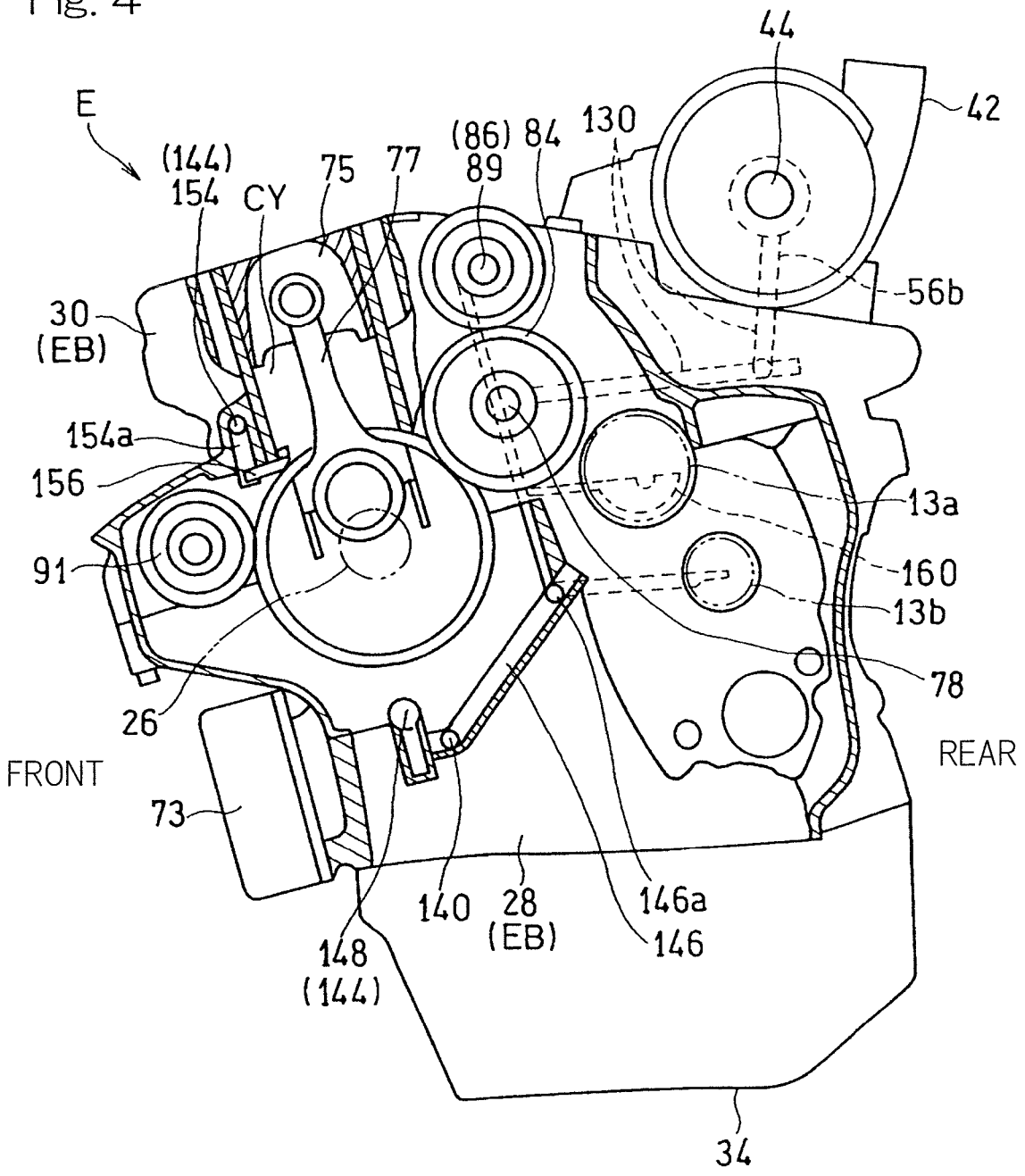
FIG. 4 is a longitudinal cross-sectional view showing a principal part of the combustion engine.

As shown in FIG. 4, a piston 75 is disposed within a cylinder CY and is connected to the crankshaft 26 through a connecting rod 77.

Figure 6:
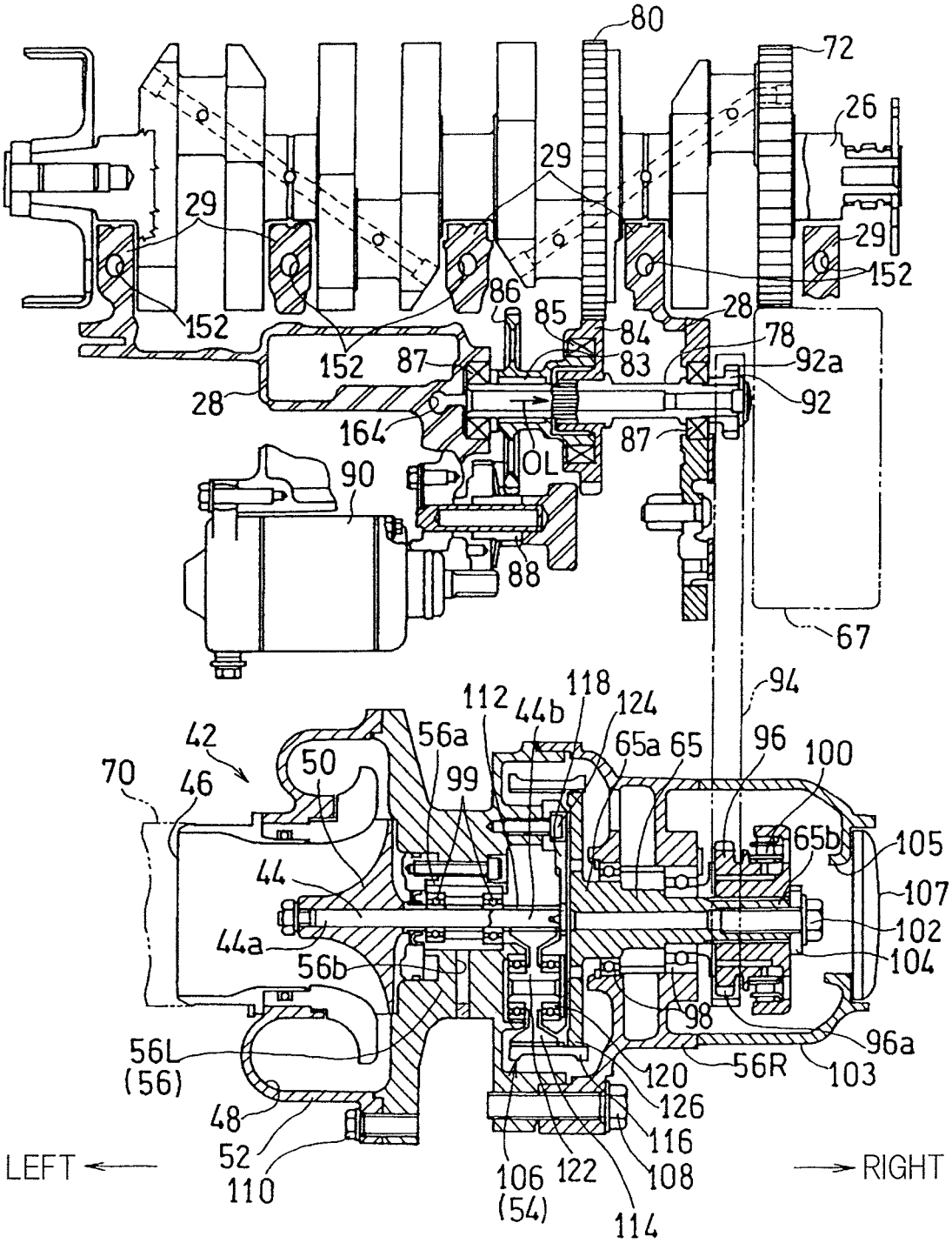
FIG. 6 is an axial arrangement diagram of the combustion engine.

As shown in FIG. 6, a clutch gear 72 which drives a clutch 67 is provided on an end portion, at the right side which is one side in the widthwise direction of the motorcycle, of the crankshaft 26 of the combustion engine E, and a supercharger gear 80 which drives the supercharger 42 is provided at the left side of the clutch gear 72 in the crankshaft 26. A driven-side supercharger gear 84 which meshes with the supercharger gear 80 on the crankshaft 26 is spline-fitted to a supercharger drive shaft 78 so as to rotate therewith. The supercharger drive shaft 78 is rotatably supported by the crankcase 28 through a bearing 87.

In the present embodiment, the supercharger gear 80 shown in FIG. 4 also serves as an idler gear which drives a first balancer shaft 89 that rotates in the same direction as the crankshaft 26. A second balancer shaft 91 which rotates in a direction opposite to that of the crankshaft 26 is disposed at a side opposite to the supercharger drive shaft 78 across the crankshaft 26.

A starter gear 86 shown in FIG. 6 is supported by the supercharger drive shaft 78 through a roller bearing 83 so as to be rotatable relative to the supercharger drive shaft 78, and a starter one-way clutch 85 is interposed between the driven-side supercharger gear 84 and the starter gear 86. A starter motor 90 is connected to the starter gear 86 through a torque limiter 88.

A first sprocket 92 is provided at a right end portion of the supercharger drive shaft 78. A chain 94 which is an endless power transmission member that transmits power of the combustion engine E to the supercharger 42 is entrained on a gear 92*a* of the first sprocket 92. The chain 94 is disposed at the right side which is a side opposite to the suction port 46 of the supercharger 42 in the widthwise direction of the motorcycle.

A rotational force of the crankshaft 26 is transmitted from the supercharger drive shaft 78 through the chain 94 to an input shaft 65 which is connected to the supercharger rotation shaft 44. Specifically, a sprocket 96 is provided at a right end portion of the input shaft 65, and the chain 94 is entrained on a gear 96*a* of the second sprocket 96. The input shaft 65 is a rotation shaft of the speed increaser 54.

The input shaft 65 is in the form of a hollow shaft and is rotatably supported by the casing 56 through a bearing 98. Spline teeth are formed on the outer peripheral surface of the right end portion 65*b* of the input shaft 65, and a one-way clutch 100 is spline-fitted to the outer peripheral surface of the right end portion 65*b*. The second sprocket 96 is connected to the input shaft 65 through the one-way clutch 100.

An internal thread portion is formed on the inner peripheral surface of the right end portion 65*b* of the input shaft 65, and the one-way clutch 100 is mounted on the right end portion 65*b* through a washer 104 by a head portion of a bolt 102 screwed into the internal thread portion. The one-way clutch 100, the second sprocket 96, and the bolt 102 are accommodated in a sprocket cover 103 connected to a right end portion of the casing 56. The sprocket cover 103 has a right end portion formed with an opening 105 to face toward the outside of the motorcycle, and the opening 105 is closed by a cap 107. The sprocket cover 103 and the casing 56 may be integrally formed.

The impeller 50 is fixed to a left end portion 44*a* of the supercharger rotation shaft 44 of the supercharger 42, and a right side portion 44*b* of the supercharger rotation shaft 44 is connected to a left end portion 65*a* of the input shaft 65 through a planetary gear device 106 which is the speed increaser 54.

The supercharger rotation shaft 44 is rotatably supported by the casing 56 through a bearing 99. The bearing 99 is accommodated in a bearing holder 101. The casing 56 includes an input shaft case portion 56R which supports the input shaft 65 and a rotation shaft case portion 56L which supports the supercharger rotation shaft 44, and the input shaft case portion 56R and the rotation shaft case portion 56L are connected to each other by using a casing fastening member 108 such as a bolt. Furthermore, the impeller housing 52 is connected to the rotation shaft case portion 56L of the casing 56 by using a housing fastening member 110 such as a bolt, and the sprocket cover 103 is connected to the input shaft case portion 56R. The impeller housing 52 has the suction port 46 opened leftward and the discharge port 48 opened upward.

The sprocket cover 103 is fixed to the crankcase 28 by means of the bolts 57 (FIG. 2). That is, the casing 56 and the impeller housing 52 are supported by the crankcase 28 through the sprocket cover 103, and are disposed so as to be spaced apart from the upper surface of the crankcase 28 in the up-down direction. In other words, the casing 56 and the impeller housing 52 are supported by the sprocket cover 103 at one end thereof.

Figure 7:
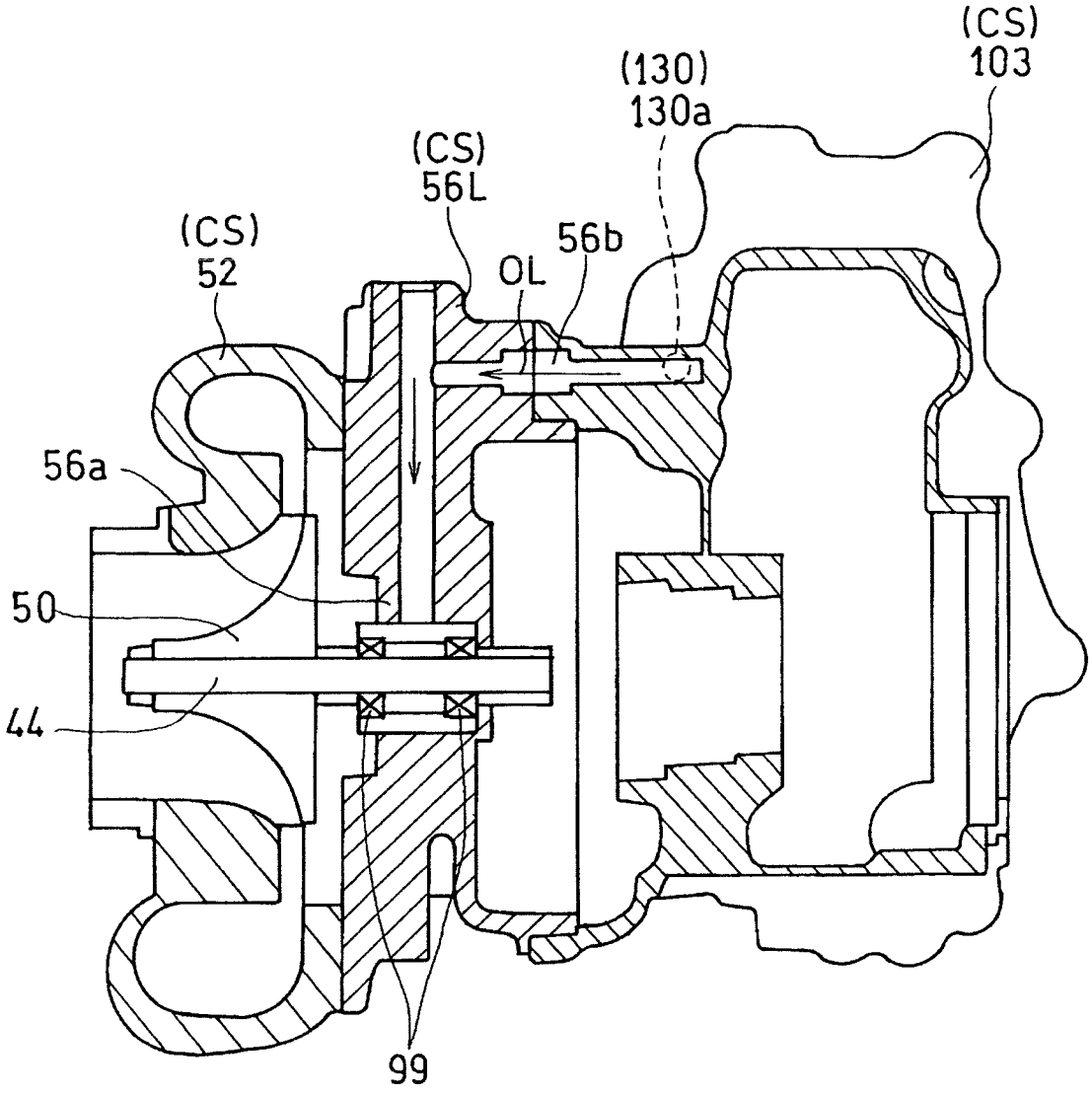
FIG. 7 is a horizontal cross-sectional view showing the supercharger of the combustion engine.

The supercharger case CS shown in FIG. 7 includes a bearing portion 56*a* which supports the supercharger rotation shaft 44 of the supercharger 42 and a supercharger case-side lubricating oil passage 56*b*. The supercharger case-side lubricating oil passage 56*b* communicates with an exit 130*a* of a supercharger lubrication passage 130 formed within the crankcase 28, and introduces the lubricating oil to the bearing portion 56*a*. Incoming wind is likely to collide against the crankcase 28, and further the crankcase 28 is formed from metal. Thus, the crankcase 28 dissipates heat, thereby suppressing temperature increase. The supercharger lubrication passage 130 is preferably formed in a relatively-low-temperature portion of the crankcase 28, such as a portion away from the cylinder block 30 and a portion at the outer side in the widthwise direction of the motorcycle against which portion incoming wind is likely to collide. The supercharger lubrication passage 130 will be described in detail later.

As described above, the planetary gear device 106 shown in FIG. 6 is disposed between the input shaft 65 and the supercharger rotation shaft 44, and is supported by the casing 56. External teeth 112 are formed on the right end portion 44*b* of the supercharger rotation shaft 44, and a plurality of planetary gears 114 are arranged in a circumferential direction and is gear-connected to or meshed with the external teeth 112. That is, the external teeth 112 of the supercharger rotation shaft 44 function as a sun gear of the planetary gear device 106. Furthermore, the planetary gears 114 are gear-connected to a large-diameter internal gear (ring gear) 116 at the outer side in a radial direction. Each planetary gear 114 is rotatably supported by a carrier shaft 122 through a bearing 120 mounted on the casing 56.

The carrier shaft 122 includes a fixed member 118, and the fixed member 118 is fixed to the casing 56 by means of a bolt 124. That is, the carrier shaft 122 is fixed. An input gear 126 is provided on the left end portion of the input shaft 65, and is gear-connected to the internal gear 116. As described above, the internal gear 116 is gear-connected to the input gear 126 so as to rotate in the same rotation direction as the input shaft 65, and while the carrier shaft 122 is fixed, the planetary gears 114 rotate in the same rotation direction as the internal gear 116. The sun gear (external gear 112) is formed on the supercharger rotation shaft 44 which is an output shaft, and rotates in a rotation direction opposite to that of the planetary gears 114. That is, the planetary gear device 106 increases the speed of rotation of the input shaft 65, and transmits the rotation in the rotation direction opposite to that of the input shaft 65, to the supercharger rotation shaft 44.

Figure 8:
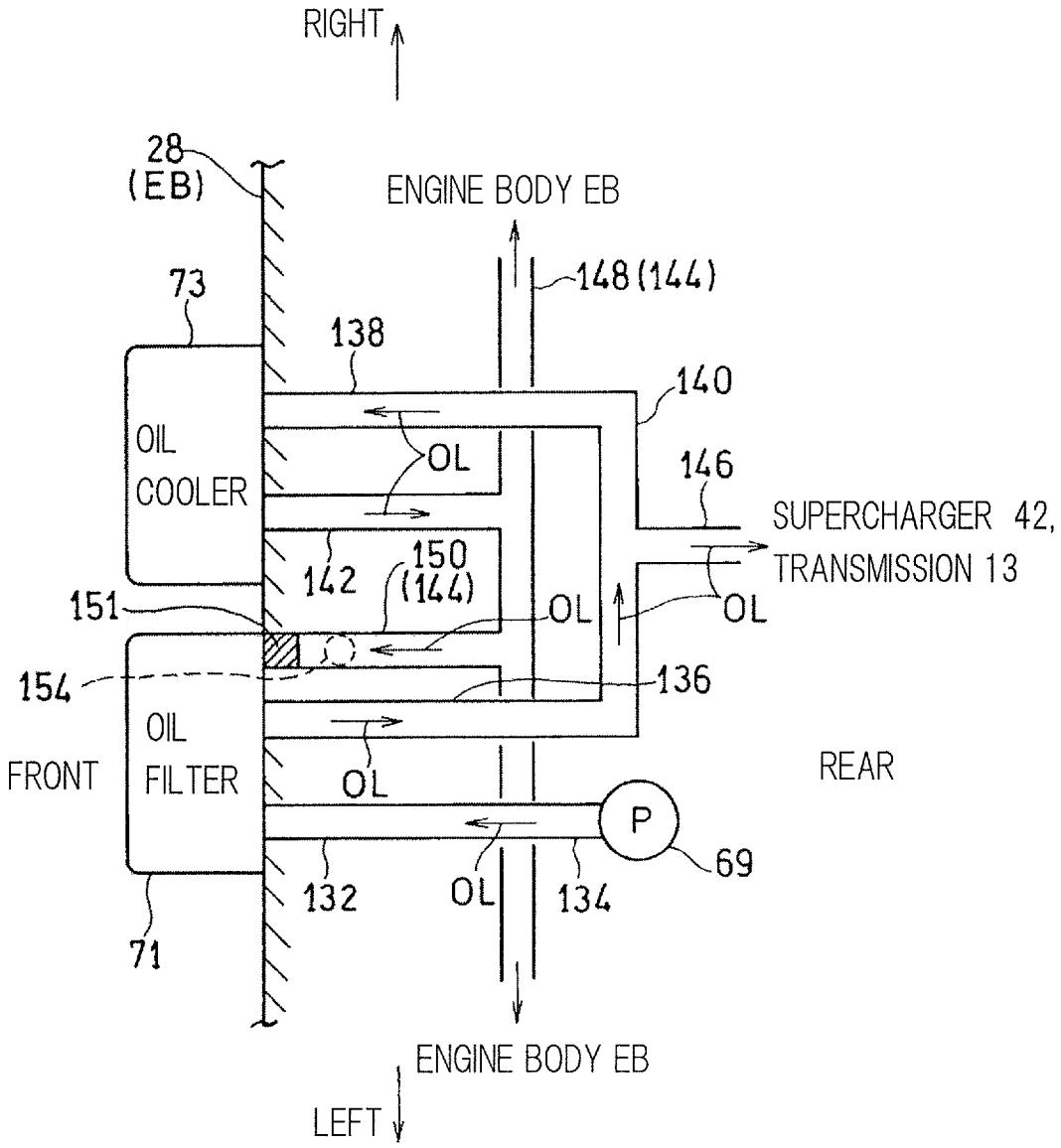
FIG. 8 is a system diagram schematically showing a part of the lubrication system of the combustion engine.

As shown in FIG. 8, a discharge passage 134 for the oil pump 69 is connected to an inflow passage 132 for the oil filter 71, and an outflow passage 136 for the oil filter 71 and an inflow passage 138 for the oil cooler 73 communicate with each other through a filter-cooler communication passage 140. An outflow passage 142 at the downstream side of the oil cooler 73 communicates with an engine lubrication passage 144 which is a main lubrication passage that supplies the lubricating oil to the engine body EB. The inflow passage 132 and the outflow passage 136 for the oil filter 71 and the inflow passage 138 and the outflow passage 142 for the oil cooler 73 are formed in a front wall of the crankcase 28 and extend in the front-rear direction.

A sub lubrication passage 146 which supplies the lubricating oil OL to the transmission 13, the supercharger 42, the supercharger drive shaft 78, and the like is connected between the oil filter 71 and the oil cooler 73, specifically, to the filter-cooler communication passage 140. That is, the oil pump 69 supplies the shared lubricating oil OL to both the main lubrication passage (engine lubrication passages) 144 and the sub lubrication passage 146.

The main lubrication passage 144 includes a first engine lubrication passage 148 which is connected to the outflow passage 142 for the oil cooler 73 and extends in the right-left direction (the first direction) and a second engine lubrication passage 150 which is connected to the first engine lubrication passage 148 and extends frontward (toward the oil filter side). The second engine lubrication passage 150, the inflow passage 132 and the outflow passage 136 for the oil filter 71, and the inflow passage 138 and the outflow passage 142 for the oil cooler 73 are formed within a wall of the engine body EB so as to be parallel to each other.

A part of the first engine lubrication passage 148 and the filter-cooler communication passage 140 are formed within the wall of the crankcase 28 so as to be parallel to each other. That is, the part of the first engine lubrication passage 148 and the filter-cooler communication passage 140 extend in the right-left direction (first direction).

Figure 10:
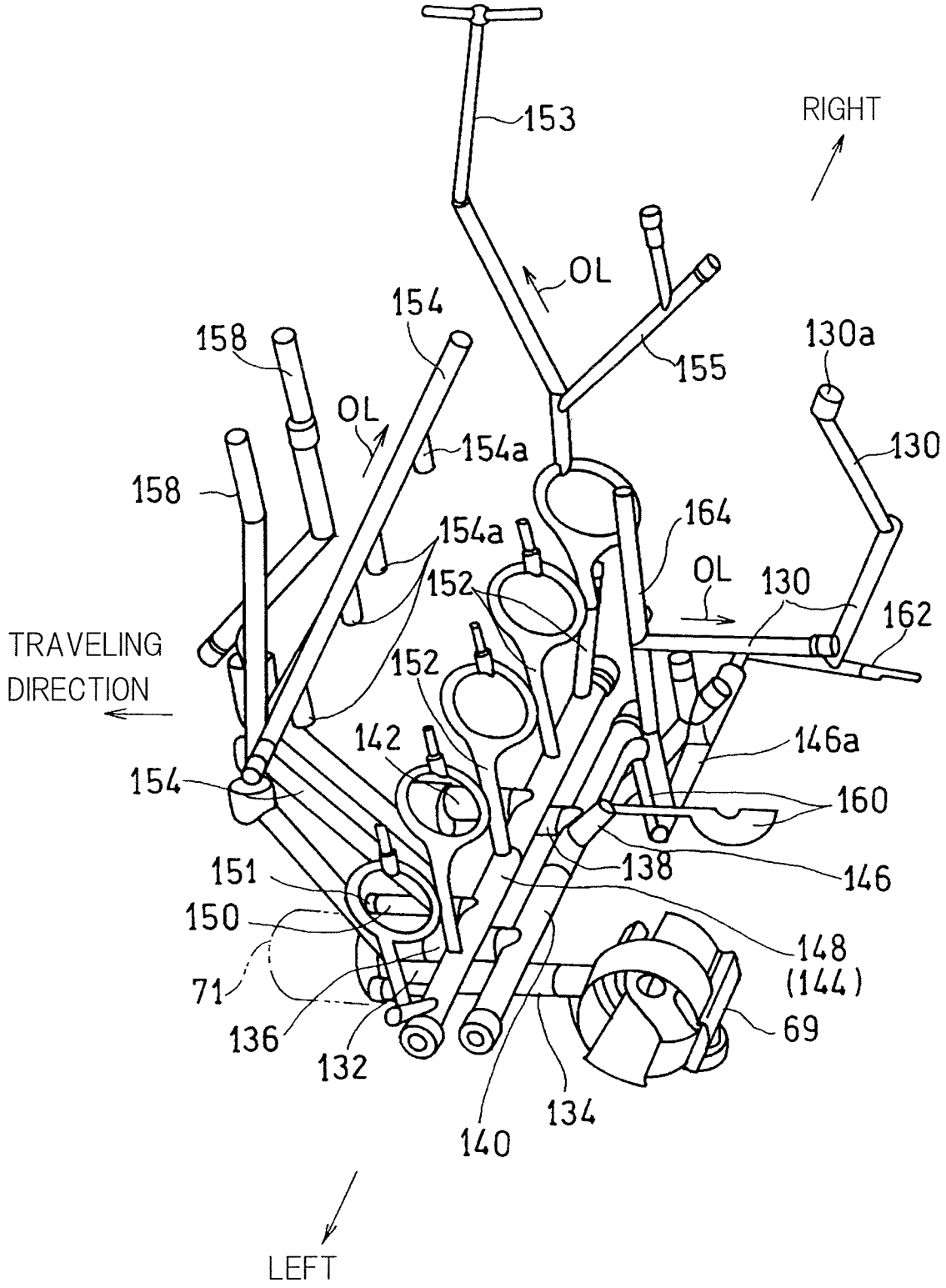
FIG. 10 is a system diagram of the lubrication system of the combustion engine, as seen obliquely from the rear lateral side.

First, the main lubrication passage 144 including the engine lubrication passages will be described. FIGS. 9 and 10 show lubrication passages formed within the walls of the crankcase 28 and the cylinder block 30. As shown in FIG. 9, five crankshaft bearing lubrication passages 152 extend upward from the first engine lubrication passage 148 which extends in the right-left direction. The crankshaft bearing lubrication passages 152 are formed within bearing portions 29 in the crankcase 28 shown in FIG. 6 and supply the lubricating oil OL into lubricating bearing surfaces of the crankshaft 26.

Figure 5:
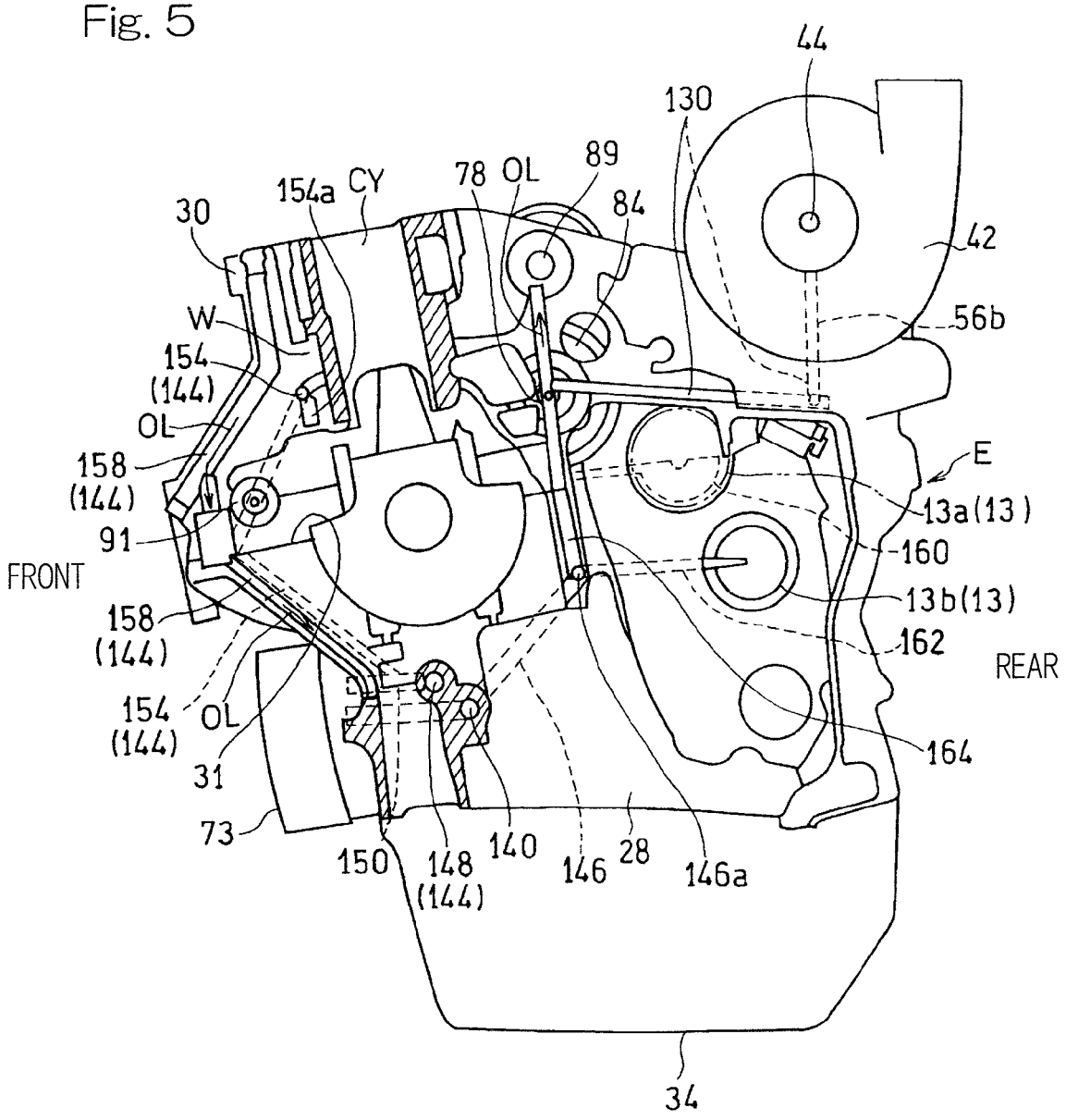
FIG. 5 is a longitudinal cross-sectional view different from FIG. 4, showing the principal part of the combustion engine.

The main lubrication passage 144 shown in FIG. 10 further includes a third engine lubrication passage 154 which extends from the second engine lubrication passage 150 in the upward direction which is a second direction. Specifically, as shown in FIG. 5, the third engine lubrication passage 154 extends within the wall of the crankcase 28 obliquely frontward and upward from the second engine lubrication passage 150, also extends therein obliquely rearward and upward from the division surface 31 of the crankcase 28 divided into the two upper and lower halves, and further extends within a front wall W of the cylinder CY in the right-left direction.

As shown in FIG. 10, four outlet passage portions 154*a* facing downward are formed within the wall of the crankcase 28 and at a portion of the third engine lubrication passage 154, which portion extends in the right-left direction. A lubricating oil spraying nozzle 156 shown in FIG. 4 is connected to an exit end which is a lower end of each outlet passage portion 154*a*. The lubricating oil spraying nozzle 156 jets out the lubricating oil upward toward a rear surface of the piston 75 from the front side of the cylinder CY. That is, the third engine lubrication passage 154 includes a piston jet lubrication passage which sprays the lubricating oil toward the piston 75.

A front end portion of the second engine lubrication passage 150 which extends frontward as shown in FIG. 10 is closed by a closing member 151. The closing member 151 is disposed inward of the oil filter 71, namely, rearward of the oil filter 71, such that the closing member 151 is not visible from the outside.

Furthermore, fourth engine lubrication passages 153, 155 are provided at the rightmost crankshaft bearing lubrication passage 152 so as to extend upward therefrom. The fourth engine lubrication passages 153, 155 supply the lubricating oil OL to a wall surface of the cylinder and a cam chain (not shown) which drives a camshaft. The fourth engine lubrication passages 153, 155 are formed within the walls of the crankcase 28 and the cylinder block 30.

The lubricating oil supplied to the wall surface of the cylinder through the fourth engine lubrication passages 153, 155 is returned through lubricating oil return passages 158 shown in FIG. 9 to the downstream side of the oil filter 71 and the upstream side of the oil cooler 73. Specifically, as shown in FIG. 5, the lubricating oil return passages 158 extend within a front wall of the cylinder block 30 obliquely frontward and downward, and extend obliquely rearward and downward from the division surface 31 of the crankcase 28. The lubricating oil returned to the upstream side of the oil cooler 73 through the lubricating oil return passages 158 is cooled by the oil cooler 73, and is supplied to the engine lubrication passage 148 again.

Next, the sub lubrication passage 146 will be described. As shown in FIG. 10, the sub lubrication passage 146 extends within the wall of the crankcase 28 obliquely rearward and upward from the filter-cooler communication passage 140, and includes a horizontal passage portion 146*a* which extends in the right-left direction within the wall of the crankcase 28 and in rear of the crankshaft 26 (FIG. 4).

A transmission input shaft lubrication passage 160 is formed at a left end portion of the horizontal passage portion 146*a* and within the wall of the crankcase 28 so as to extend upward. The transmission input shaft lubrication passage 160 extends rearward in the shape of groove formed in an abutting or mating surface of the crankcase 28, and supplies the lubricating oil to an input shaft 13*a* of the transmission 13 shown in FIG. 4.

A transmission output shaft lubrication passage 162 is formed at the right end of the horizontal passage portion 146*a* shown in FIG. 9 so as to extend rearward. The transmission output shaft lubrication passage 162 extends rearward from a right end portion of the horizontal passage portion 146*a* by a pipe shape of a transmission holder, and supplies the lubricating oil to an output shaft 13*b* of the transmission 13 shown in FIG. 4. The transmission input shaft lubrication passage 160 and the transmission output shaft lubrication passage 162 constitute a transmission lubrication passage which supplies the lubricating oil into the transmission 13.

An idler lubrication passage 164 is formed at the left end portion of the horizontal passage portion 146*a* shown in FIG. 9 so as to extend upward. That is, the idler lubrication passage 164 extends upward within the wall of the crankcase 28 and at the inner side (right side) of the transmission input shaft lubrication passage 160. As shown in FIG. 5, the idler lubrication passage 164 extends upward within the wall of the crankcase 28 to supply the lubricating oil OL to the supercharger drive shaft 78, and further extends upward within the wall of the crankcase 28 to supply the lubricating oil to the first balancer shaft 89.

Specifically, as shown in FIG. 6, the idler lubrication passage 164 supplies the lubricating oil OL into the inside of the supercharger drive shaft 78 from the left end of the supercharger drive shaft 78, which is a hollow shaft, and supplies the lubricating oil to the roller bearing 83 and the sprocket 92.

The supercharger lubrication passage 130 that extends rearward is formed near a passage portion of the idler lubrication passage 164 shown in FIG. 5, which passage portion supplies the lubricating oil to the supercharger drive shaft 78. The supercharger lubrication passage 130 extends within the wall of the crankcase 28 to the rear portion of the crankcase 28, then extends toward the right side (the back side of the surface of the sheet), and further extends upward to supply the lubricating oil to the supercharger rotation shaft 44 of the supercharger 42. That is, the supercharger lubrication passage 130 is formed within the wall of the low-temperature crankcase 28 so as to extend to an upper portion of the crankcase 28. As described above, a part of the supercharger lubrication passage 130 extends near the upper surface of the crankcase 28 above the transmission 13. Therefore, heat is dissipated from the upper surface of the crankcase 28, thereby allowing a reduction in the temperature of the lubricating oil to be supplied to the supercharger 42.

Specifically, as shown in FIG. 3, the exit 130*a* of the supercharger lubrication passage 130 is formed in an abutting or mating surface 166 of the crankcase 28 which abuts the supercharger case CS. The supercharger lubrication passage 130 is connected directly to the supercharger case-side lubricating oil passage 56*b* shown in FIG. 7, and supplies the lubricating oil to the bearing portion 56*a* of the supercharger case CS.

A second oil filter (not shown) is disposed at the abutting surface 166. The second oil filter filters the oil flowing from the crankcase 28 into the supercharger case CS, and prevents liquid clogging from occurring in lubrication of the supercharger 42. As compared to the oil filter 71 which is a main filter, the second oil filter is small in size and has low passage resistance, and is used for removing fine contaminants. The second oil filter may be disposed at the supercharger lubrication passage 130, and the location where the second oil is disposed is not limited to the abutting surface 166. The transmission lubrication passages 160, 162, the idler lubrication passage 164, and the supercharger lubrication passage 130 constitute the sub lubrication passage 146 shown in FIG. 8.

As shown in FIG. 7, the lubricating oil introduced to the supercharger 42 is supplied through the interior of the casing 56 to the bearing portion 56*a*. Seal members (not shown) are respectively disposed at the abutting surface between the crankcase 28 and the sprocket cover 103 and an abutting surface between the sprocket cover 103 and the casing 56. Accordingly, it is possible to suppress formation of a gap around the lubrication passage and to prevent oil leakage. A part of the lubricating oil passage may be formed within a bolt which connects the sprocket cover 103 and the casing 56.

Figure 11:
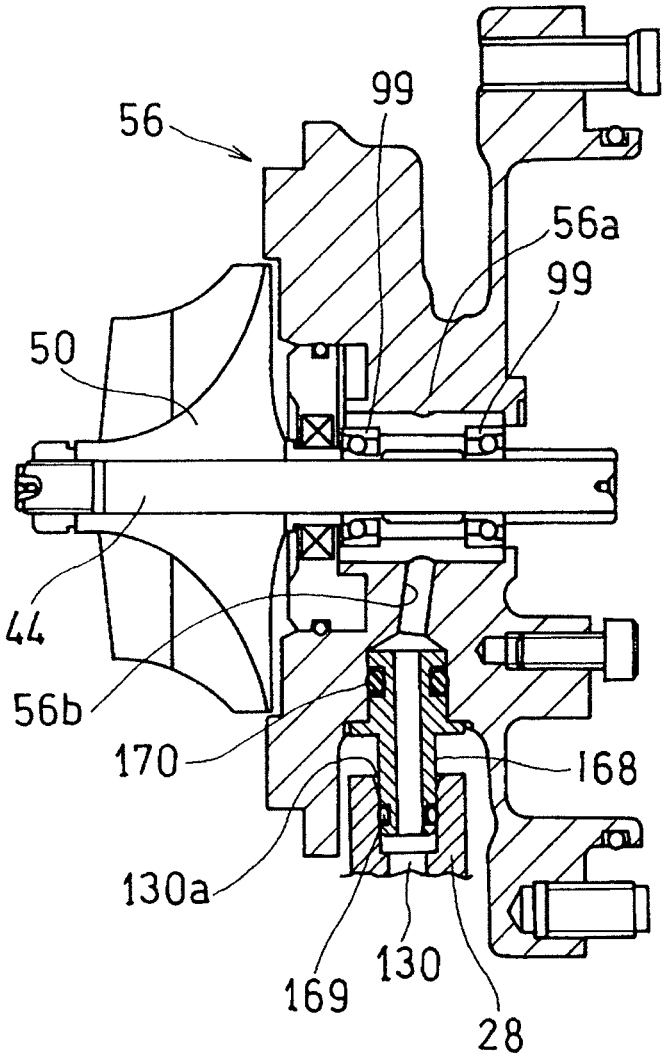
FIG. 11 is a longitudinal cross-sectional view showing another example of the lubrication system.

FIG. 11 shows another example of a passage portion where the supercharger lubrication passage 130 and the supercharger case-side lubricating oil passage 56*b* are connected to each other. In this example, the exit 130*a* of the supercharger lubrication passage 130 is formed near the bearing portion 56*a* of the supercharger case CS, and the exit 130*a* of the supercharger lubrication passage 130 and the supercharger case-side lubricating oil passage 56*b* are connected to each other through a tubular pipe 168. Seal members 169, 170 such as 0-rings are interposed between the pipe 168 and the crankcase 28 and between the pipe 168 and the supercharger case CS, respectively. Accordingly, a tilt of the pipe 168 is absorbed.

The lubricating oil introduced through the supercharger lubrication passage 130 to the supercharger 42 is supplied to the bearing 99 for the supercharger rotation shaft 44 or an oil film (not shown) formed between the bearing holder 101 and the supercharger case CS. In the present embodiment, the oil film is formed such that the supercharger rotation shaft 44 can be supported even if shaft wobbling occurs due to the planetary gear device 106. Thus, it is necessary to supply the lubricating oil to the supercharger 42. In addition, in the present embodiment, since a centrifugal supercharger is used as the supercharger 42 and the supercharger 42 rotates at a high speed, a need to supply the lubricating oil to rotary portions of the supercharger 42 is high. Furthermore, since the speed increaser 54 is used, the number of rotary portions that rotate at a high speed is increased, and therefore, a required amount of the lubricating oil is increased.

The lubricating oil is further supplied to tooth surfaces of each gear of the planetary gear device 106 (speed increaser 54) and the bearings 120 which support the planetary gears 114. Moreover, a power transmission mechanism, specifically, the sprocket 96, the one-way clutch 100, and the like, may be lubricated by the use of the lubricating oil introduced to the supercharger 42. Accordingly, it is unnecessary to additionally form an oil supply passage to the power transmission mechanism, thereby increasing degree of freedom in designing.

The supercharger 42 in FIG. 5 is disposed at a position more away from the oil filter 71 (FIG. 1) than the transmission 13, and the supercharger lubrication passage 130 branches from the transmission lubrication passages 160, 162 which supply the lubricating oil to the transmission 13. Accordingly, it is possible to prevent the sub lubrication passage 146 from being undesirably made long. Furthermore, the supercharger lubrication passage 130 branches from the idler lubrication passage 164 which supplies the lubricating oil into the supercharger drive shaft 78 and the first balancer shaft 89, both of which form a part of the combustion engine. Accordingly, it is possible to further shorten the sub lubrication passage 146. As described above, other than the oil pump 69 and the oil filter 71, the supercharger lubrication passage 130 also shares a part of the lubrication passage with the combustion engine.

As lubrication targets to which the lubricating oil is supplied through the sub lubrication passage 146, components having a low cooling requirement, such as a balancer, a starter motor gear, are preferable in addition to the transmission 13, the supercharger drive shaft 78, and the first balancer shaft 89. The lubrication targets having a low cooling requirement may be disposed, for example, at positions separated from a space where the piston 75 and the crankshaft 26 shown in FIG. 4 are disposed and which are less affected by temperature increase caused by explosion of a fuel within a cylinder.

Figure 12:
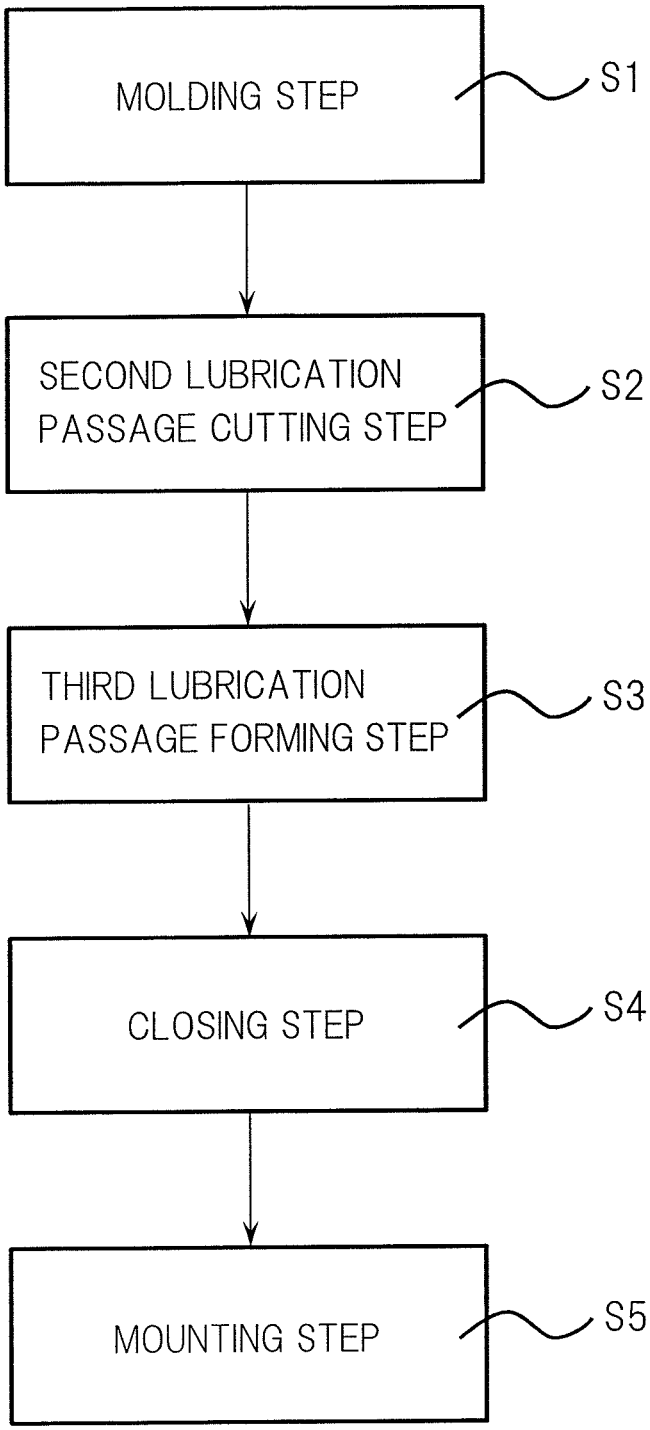
FIG. 12 is a flowchart showing a process of manufacturing the lubrication system of the combustion engine.

FIG. 12 shows a process of manufacturing the lubrication system for the combustion engine according to the present invention. The engine body of the combustion engine E is formed by molding, and the first to third lubrication passages 148, 150, and 154 (FIG. 8) are formed within the engine body. The process of manufacturing the lubrication system for the combustion engine includes a molding step S1, a second lubrication passage cutting step S2, a third lubrication passage forming step S3, a closing step S4, and a mounting step S5.

In the molding step S1, the inflow passage 132 and the outflow passage 136 for the oil filter 71, the inflow passage 138 and the outflow passage 142 for the oil cooler 73, and the second engine lubrication passage 150 shown in FIG. 8 are roughly formed by using the same mold member. In the second lubrication passage cutting step S2 (FIG. 12), cutting is performed on the second engine lubrication passage 150 formed roughly in the molding step S1.

In the third lubrication passage forming step S3 (FIG. 12), the third engine lubrication passage 154 to be connected to the second engine lubrication passage 150 is formed. In the closing step S4 (FIG. 12), the opening of the second engine lubrication passage 150 is closed by the closing member 151. In the mounting step S5 (FIG. 12), the oil filter 71 and the oil cooler 73 are mounted on the outer surface of the engine body.

In the present embodiment, the second engine lubrication passage 150 is disposed parallel to each of the inflow passage 132 and the outflow passage 136 for the oil filter 71 and the inflow passage 138 and the outflow passage 142 for the oil cooler 73, but may be disposed parallel to at least one of these passages. However, the second engine lubrication passage 150 is preferably disposed parallel to all of these passages as in the present embodiment, and a direction of mold removal is preferably set so as to be parallel to each of these passages. Accordingly, it is possible to reduce an amount of cutting in passage formation after molding, and it is possible to reduce the material cost.

In the present embodiment, the second engine lubrication passage 150 is disposed between the oil filter 71 and the oil cooler 73 in the right-left direction (first direction), and is formed at the back side of the oil filter 71 whose outer shape is larger than that of the oil cooler 73. Accordingly, it is possible to make the second engine lubrication passage 150 less noticeable as compared to the case where the second engine lubrication passage 150 is formed at the back side of the oil cooler 73. Since the second engine lubrication passage 150 is formed between the oil filter 71 and the oil cooler 73, an increase in the size of a mold is suppressed, thereby allowing the manufacturing cost to be reduced. In addition, even in the case where the passages are formed by cutting, not by molding, a required movement amount of a tool is small, and therefore, the workability is good. However, the second engine lubrication passage 150 may be disposed at the outer side of the oil filter 71 and the oil cooler 73 in the right-left direction (first direction).

The inflow passage 132 and the outflow passage 136 for the oil filter 71 shown in FIG. 10 are aligned vertically. Specifically, the outflow passage 136 is disposed above the inflow passage 132. The second engine lubrication passage 150 is disposed further above the inflow passage 132 and the outflow passage 136. Accordingly, it is possible to prevent interference with the inflow passage 132 and the outflow passage 136 and to shorten the third engine lubrication passage 154 which extends upward.

The first engine lubrication passage 148 is parallel to the filter-cooler communication passage 140 and is disposed above and frontward of the filter-cooler communication passage 140. Since the filter-cooler communication passage 140 is disposed rearward, interference between the filter-cooler communication passage 140 and the first engine lubrication passage 148 is prevented, and thus, it is easy to form the lubrication passage to the transmission 13 (FIG. 1) or the supercharger 42 (FIG. 1) disposed in a rear portion of the combustion engine. The filter-cooler communication passage 140 extends in the right-left direction and connects the outflow passage 136 for the oil filter 71 and the inflow passage 132 for the oil cooler 73. That is, the outflow passage 136 for the oil filter 71 and the inflow passage 132 for the oil cooler 73 are located at the same height position.

The outflow passage 142 for the oil cooler 73 shown in FIG. 9 is located above the inflow passage 138 for the oil cooler 73. The outflow passage 142 for the oil cooler 73 and the second engine lubrication passage 150 are located at the same height position. The first engine lubrication passage 148 extends in the right-left direction and connects the outflow passage 142 for the oil cooler 73 and the second engine lubrication passage 150.

In the present embodiment, the third engine lubrication passage 154 is connected to the second engine lubrication passage 150 shown in FIG. 8. Since the outflow passage 142 for the oil cooler 73 also supplies the lubricating oil to a passage other than the third engine lubrication passage 154, a. setting range of the passage diameter of the outflow passage 142 is limited. On the other hand, since the second engine lubrication passage 150 does not supply the lubricating oil to a passage other than the third engine lubrication passage 154, the diameter of the second engine lubrication passage 150 can be set to a diameter suitable for supplying the lubricating oil to the third engine lubrication passage 154. As described above, it is possible to arbitrarily set the passage diameter when the third engine lubrication passage 154 is formed at the second engine lubrication passage 150, as compared to the case where the third engine lubrication passage 154 is formed at the outflow passage 142 for the oil cooler 73. As a result, the degree of freedom in designing the passage arrangement increases, and it is easy to locate the passage at a position where interference with another component is prevented.

When the crankshaft 26 shown in FIG. 6 rotates, the supercharger drive shaft 78 rotates in conjunction with the crankshaft 26 because of the mesh between the supercharger gear 80 and the driven-side supercharger gear 84. When the supercharger drive shaft 78 rotates, the input shaft 65 rotates through the chain 94, and further the supercharger rotation shaft 44 rotates through the planetary gear device 106, so that the supercharger 42 starts up.

When the motorcycle travels, incoming wind A shown in FIG. 1 enters the intake duct 70 through the intake air inlet 24, and is compressed therein by a dynamic pressure (ram pressure). The compressed air enters the air cleaner 40 through the intake duct 70, and then is, after cleaned by the air cleaner 40, introduced into the supercharger 42. The intake air I introduced into the supercharger 42 is pressurized by the supercharger 42 and is introduced into the combustion engine E through the intake air chamber 74 and the throttle body 76. Because of a synergetic effect of the pressurization by the ram pressure and the pressurization by the supercharger 42 as described above, it is possible to supply the high-pressure intake air I to the combustion engine E.

When the combustion engine E rotates, the oil pump 69 shown in FIG. 8 is driven in conjunction with the combustion engine E. The lubricating oil OL discharged from the oil pump 69 is cleaned by the oil filter 71 and then flows into the oil cooler 73.

Part of the lubricating oil OL cleaned by the oil filter 71 is supplied to the input and output shafts 13*a*, 13*b* of the transmission 13, the supercharger drive shaft 78, the first balancer shaft 89, and the supercharger rotation shaft 44 shown in FIG. 5 through the sub lubrication passage 146, without flowing through the oil cooler 73. Since the lubricating oil OL is supplied from the upstream side of the oil cooler 73 as described above, it is possible to suppress a reduction in the pressure in the main lubrication passage 144 at the downstream side of the oil cooler 73, which is caused due to the formation of the sub lubrication passage 146.

In addition, the cooled lubricating oil OL is supplied from the downstream side of the oil cooler 73 shown in FIG. 8 through the main lubrication passage 144 to the engine body. Specifically, the lubricating oil OL flowing through the main lubrication passage 144 is used for cooling an inner wall surface of the cylinder CY shown in FIG. 5, lubricating the second balancer shaft 91, spraying to the piston 75 shown in FIG. 4, and lubricating the bearing portions 29 of the crankshaft 26 in the crankcase 28 shown in FIG. 6.

In the configuration described above, since it is possible to lubricate the engine body EB, the transmission 13, and the supercharger 42 with the single oil pump 69, the oil pan 34, and the oil filter 71 shown in FIG. 8, as compared to the case where the oil pump 69, the oil filter 71, and the like are provided separately to the combustion engine and the supercharger, it is possible to simplify the structure around the combustion engine, thereby suppressing an increase in the size of the combustion engine E.

The supercharger lubrication passage 130, the transmission lubrication passages 160, 162, and the idler lubrication passage 164 shown in FIG. 5 are located at the upstream side of the oil cooler 73 in the flow direction. Therefore, it is possible to suppress a reduction in the pressure in the main lubrication passage 144 at the downstream side of the oil cooler 73, which is caused due to the formation of these passages. In addition, since the idler lubrication passage 164 and the supercharger lubrication passage 130 are connected in series, the passages are simplified.

The lubricating oil OL is supplied through the main lubrication passage 144 to the crankshaft bearing portions 29, the piston 75, and the wall surface of the cylinder CY. Since these are portions forming the combustion engine E, and are likely to be increased in temperature due to explosive combustion of fuel, there is a need to be cooled. So, the cooled lubricating oil OL having passed through the oil cooler 73 is supplied thereto, and therefore, it is possible to effectively cool these portions.

Since the supercharger lubrication passage 130 is formed within the wall of the crankcase 28 so as to extend to the upper portion of the crankcase 28, the lubricating oil OL flowing through the supercharger lubrication passage 130 is cooled by heat being dissipated from the crankcase 28. In addition, since the supercharger lubrication passage 130 is not exposed from the crankcase 28, the appearance of the combustion engine improves, and it is also possible to prevent the lubricating oil OL from leaking out of the crankcase 28.

The exit 130*a* of the supercharger lubrication passage 130 shown in FIG. 3 is formed in the abutting surface 166 of the crankcase 28 and the supercharger case CS and communicates with the supercharger case-side lubricating oil passage 56*b* shown in FIG. 7. Thus, when the supercharger case CS is merely mounted on the crankcase 28, the passage leading to the bearing portion 56*a* of the supercharger case CS is formed. Accordingly, the workability improves. In addition, since it is not necessary to form a passage outside the supercharger case CS by using a tube or the like, thus it is possible to prevent oil leak from occurring at a portion where the tube and the case are connected to each other, and also the appearance improves.

In the case where the exit 130*a* of the supercharger lubrication passage 130 and the supercharger case-side lubricating oil passage 56*b* are connected to each other through the pipe 168 as shown in FIG. 11, it is possible to shorten the supercharger lubrication passage 130 formed within the crankcase 28.

Since the inflow passage 132 and the outflow passage 136 for the oil filter 71 and the second engine lubrication passage 150 are formed so as to be parallel to each other as shown in FIG. 8, it is possible to simultaneously form these passages by molding of the engine body EB. Accordingly, it is possible to easily form a plurality of lubricating oil passages in the engine body EB.

Since the closing member 151 shown in FIG. 9 is disposed inward of the oil filter 71, the closing member 151 is not exposed to the outside of the combustion engine E, and therefore, the appearance of the combustion engine E improves.

Since the third engine lubrication passage 154 which is a piston jet lubrication passage shown in FIG. 5 is formed within the wall of the engine body EB, it is possible to reduce the number of components as compared to the case where the third engine lubrication passage 154 is provided outside the engine body EB.

Since the filter-cooler communication passage 140 and the first engine lubrication passage 148 are formed so as to be parallel to each other as shown in FIG. 8, it is possible to machine these passages 140, 148 from the same direction. Accordingly, it is possible to easily form a plurality of lubricating oil passages in the engine body EB.

The oil filter 71 and the oil cooler 73 are disposed on the front surface of the crankcase 28, the inflow passage 132 and the outflow passage 136 for the oil filter 71 and the inflow passage 138 and the outflow passage 142 for the oil cooler are formed in the front wall of the crankcase 28, and the part of the first engine lubrication passage 148 and the filter-cooler communication passage 140 extend in the right-left direction (widthwise direction of the motorcycle) within the crankcase 28. Accordingly, the oil filter 71 and the oil cooler 73 do not protrude in the widthwise direction of the motorcycle to deteriorate the appearance, and it is possible to form the filter-cooler communication passage 140 and the first engine lubrication passage 148 by machining from the same direction (right-left direction).

The engine body EB is formed by an aluminum die-cast method which enables precise molding. Therefore, even if a plurality of lubrication passages have a single shape and are disposed close to each other, by forming each lubrication passage as a single pipe, it is possible to prevent occurrence of a blowhole. In addition, when gravity casting is performed, even with pipes disposed close to each other, it is possible to prevent occurrence of a cavity or blowhole.

In the embodiment described above, the inflow passage 132 and the outflow passage 136 for the oil filter 71, the inflow passage 138 and the outflow passage 142 for the oil cooler 73, and the second engine lubrication passage 150 are roughly formed by molding, but may be formed by cutting, not by molding. Even in the case where molding is not performed, since the directions of the respective passages 132, 136, 138, and 142 and the second engine lubrication passage 150 are the same, it is possible to sequentially form the respective passages 132, 136, 138, and 142 and the second engine lubrication passage 150 by changing the position of a tool without changing the attitudes of the tool and the target to be cut. Accordingly, it is possible to easily form a plurality of lubrication passages in the engine body.

The present invention is not limited to the embodiment described above, and various additions, modifications, or deletions may be made without departing from the gist of the invention. For example, in the embodiment described above, the second engine lubrication passage 150 is disposed parallel to the inflow passage 132 and the outflow passage 136 for the oil filter 71, but only may be disposed parallel to at least one of the inflow passage 132 and the outflow passage 136. In addition, in the embodiment described above, the main lubrication passage 144 supplies the lubricating oil OL to the bearing for the crankshaft 26, the piston 75, and the wall surface of the cylinder CY, but only may supply the lubricating oil to at least one of them. Therefore, these are construed as included within the scope of the present invention.

REFERENCE NUMERALS

28 . . . crankcase (engine body EB)
30 . . . cylinder block (engine body EB)
42 . . . supercharger
44 . . . supercharger rotation shaft
56 . . . casing (supercharger case)
56*a* . . . bearing portion
56*b* . . . supercharger case-side lubricating oil passage
69 . . . oil pump
71 . . . oil filter
73 . . . oil cooler
78 . . . supercharger drive shaft (idler shaft)
130 . . . supercharger lubrication passage
144 . . . main lubrication passage (engine lubrication passages)
148, 150, 154 . . . engine lubrication passage
160 . . . transmission input shaft lubrication passage (transmission lubrication passage)
162 . . . transmission output shaft lubrication passage (transmission lubrication passage)
164 . . . idler lubrication passage
166 . . . abutting surface
E . . . combustion engine
EB . . . engine body
OL . . . lubricating oil

What is claimed is:

1. A lubrication system for a vehicle combustion engine including a supercharger configured to pressurize intake air to be supplied to an engine body, the lubrication system comprising:

an engine lubrication passage through which lubricating oil flows to lubricate the engine body, which includes a crankcase and a cylinder block;

a supercharger lubrication passage through which lubricating oil flows to lubricate the supercharger and at least a part of the supercharger lubrication passage is formed within a wall of the crankcase;

an oil pump configured to supply a shared lubricating oil to both of the engine lubrication passage and the supercharger lubrication passage;

an oil filter disposed downstream of the oil pump in a flow direction of the lubricating oil and configured to clean the lubricating oil; and an oil cooler disposed downstream of the oil filter and configured to cool the lubricating oil, wherein the lubricating oil is supplied from a downstream side of the oil cooler through the engine lubrication passage to a to-be-lubricated portion of the combustion engine, and the lubricating oil is supplied from between the oil filter and the oil cooler through the supercharger lubrication passage to the supercharger.

2. The lubrication system for the vehicle combustion engine as claimed in claim 1, wherein the lubricating oil is supplied through the engine lubrication passage to at least one of a bearing for a crankshaft, a piston, and a wall surface of a cylinder.

3. The lubrication system for the vehicle combustion engine as claimed in claim 1, wherein the supercharger is disposed at an upper portion of the crankcase, and at least the part of the supercharger lubrication passage is formed within the wall of the crankcase so as to extend to the upper portion of the crankcase.

4. The lubrication system for the vehicle combustion engine as claimed in claim 3, wherein the supercharger is accommodated in a supercharger case mounted on the crankcase, an exit of the supercharger lubrication passage defined within the crankcase is formed in an abutting surface of the crankcase which abuts the supercharger case, and the supercharger case comprises:

a bearing portion configured to support a supercharger rotation shaft of the supercharger; and a supercharger case-side lubricating oil passage which communicates with the exit of the supercharger lubrication passage and introduces the lubricating oil to the bearing portion.

5. The lubrication system for the vehicle combustion engine as claimed in claim 3, in which the supercharger is accommodated in a supercharger case mounted on the upper portion of the crankcase, the supercharger case comprises:

a bearing portion configured to support a supercharger rotation shaft of the supercharger; and a supercharger case-side lubricating oil passage configured to introduce the lubricating oil, introduced from the supercharger lubrication passage, to the bearing portion, wherein an exit of the supercharger lubrication passage defined within the crankcase is arranged near the bearing portion of the supercharger case, and the exit of the supercharger lubrication passage communicates with an inlet of the supercharger case-side lubricating oil passage through a pipe.

6. The lubrication system for the vehicle combustion engine as claimed in claim 1, further comprising a transmission lubrication passage through which lubricating oil flows to lubricate a transmission for vehicle drive, wherein the lubricating oil is supplied to the transmission lubrication passage by the oil pump.

7. The lubrication system for the vehicle combustion engine as claimed in claim 6, wherein the lubricating oil is supplied from between the oil filter and the oil cooler to the transmission lubrication passage.

8. The lubrication system for the vehicle combustion engine as claimed in claim 1, further comprising an idler lubrication passage through which the lubricating oil flows to lubricate an idler shaft, which is a drive shaft of the supercharger, wherein the lubricating oil is supplied from between the oil filter and the oil cooler to the idler shaft, and the supercharger lubrication passage is connected to the idler lubrication passage.

* * * * *